US006293431B1

(12) United States Patent
Seymour et al.

(10) Patent No.: US 6,293,431 B1
(45) Date of Patent: Sep. 25, 2001

(54) CONTAINER WITH A DISCHARGE NOZZLE

(75) Inventors: Geoffrey F. Seymour, Wicklow (IE); Johannes H. Kelders, Drunen (NL); Roy E. Van Swieten, Heusden (NL); Erwin P. Boes, Nijmegen (NL); Philip M. Regan, Naas (IE); Luca Cella, Milan; Luigi Vanini, Albizzate, both of (IT)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/623,353

(22) PCT Filed: Feb. 27, 1999

(86) PCT No.: PCT/EP99/01290

§ 371 Date: Nov. 20, 2000

§ 102(e) Date: Nov. 20, 2000

(87) PCT Pub. No.: WO99/44907

PCT Pub. Date: Sep. 10, 1999

(30) Foreign Application Priority Data

Mar. 5, 1998 (NL) ..... 1008487
Oct. 5, 1998 (DE) ..... 198 45 686

(51) Int. Cl.[7] ..... B67D 5/00

(52) U.S. Cl. ..... 222/83; 222/91; 222/520

(58) Field of Search ..... 222/81, 83.5, 82, 222/88, 89, 91, 520, 521, 522, 523, 524, 525, 546, 563

(56) References Cited

U.S. PATENT DOCUMENTS

| | | | | |
|---|---|---|---|---|
| 3,995,773 | * | 12/1976 | Schimit | 222/91 |
| 4,640,424 | * | 2/1987 | White | 215/11 |
| 4,681,243 | * | 7/1987 | Takasugi | 222/83 |
| 4,690,304 | * | 9/1987 | Morel | 222/44 |
| 5,004,127 | * | 4/1991 | Morel | 222/521 |
| 5,052,589 | * | 10/1991 | O'Meara | 222/83 |
| 5,501,370 | * | 3/1996 | Okamura et al. | 222/111 |
| 5,769,552 | * | 6/1998 | Kelley et al. | 401/132 |
| 5,799,829 | | 9/1998 | Lier et al. . | |
| 6,000,578 | * | 12/1999 | Boissay | 222/83 |
| 6,193,108 | * | 2/2001 | Lepsius et al. | 222/83 |

FOREIGN PATENT DOCUMENTS

| | | |
|---|---|---|
| 41 26 477 | 2/1993 | (DE) . |
| 44 20 719 | 6/1994 | (DE) . |
| 0 154 345 | 9/1984 | (EP) . |
| 0 577 200 | 1/1994 | (EP) . |
| 2 058 726 | 4/1981 | (GB) . |

* cited by examiner

*Primary Examiner*—Kevin Shaver
*Assistant Examiner*—F. Nicolas
(74) *Attorney, Agent, or Firm*—Wayne C. Jaeschke; Stephen D. Harper

(57) ABSTRACT

A container capable of being easily resealed is provided having a closure cap for the outlet nozzle and an outlet opening which is sealed by a membrane. The outlet nozzle has an outlet body with an outlet channel and a connecting element for connecting the outlet body to the outlet opening of the container. An element is provided for piercing the membrane during or after the connection of the outlet body to the outlet opening of the container. This element may be configured as a part of the outlet body.

11 Claims, 9 Drawing Sheets

CONTAINER WITH A DISCHARGE NOZZLE

BACKGROUND OF THE INVENTION

1. Field of the Invention

The invention relates to a container with an outlet nozzle and a closure cap for the outlet nozzle, the container having an outlet opening, which is closed off by a membrane, and the outlet nozzle having an outlet body with an outlet channel as well as a connecting element for connecting the outlet body to the outlet opening of the container, and there being provided an element which can pierce the membrane during or after connection of the outlet body to the outlet opening of the container.

2. Discussion of the Related Art

Known containers of this type are filled with a liquid or pasty product. Relevant examples are tubes of adhesive and cartridges for joint-sealing compounds and other pasty products. Such containers are known, for example, from DE 41 26 477 C2 and DE 44 20 719 A1. The containers have three main elements, namely first of all the actual container with an outlet opening, secondly the outlet nozzle which can be attached to, or screwed onto, the outlet opening and has an elongate narrow channel, which is intended to permit precise portioning of the container contents, and thirdly a closure cap which is removed prior to the container being used. In the case of the containers known from the documents, the outlet opening of the container is closed off by a membrane, which has to be pierced prior to the container being used for the first time. Provided for this purpose, within the closure cap, is a needle-like piercing element which can be moved axially with respect to the closure cap. When the container is used for the first time, with the closure cap attached, the needle-like pin is moved downward in the direction of the outlet opening of the container, with the result that the membrane is pierced. Thereafter, the closure cap is removed from the container together with the needle-like pin, with the result that the container contents can emerge through the outlet opening and the narrow channel of the outlet nozzle in an apportioned manner.

In another known container (EP 0 155 471 A2), the membrane is fitted at the tip of the outlet nozzle. Here too, the needle-like piercing element is designed as part of the closure cap.

Following use of the container according to DE 44 20 719 A1 or DE 41 26 477 C2, the closure cap usually has to be reattached to the outlet nozzle in order to avoid unintended outflow or drying out of the container contents. For this purpose, the long, needle-like piercing element has to be reintroduced into the narrow channel of the outlet nozzle in order to close off the container opening. The disadvantage here is that this closure operation requires a certain amount of skill. In order to simplify the closure operation, the piercing element cannot, in the case of the known containers, simply be removed since, in this case, the container opening is not fully closed off when the closure cap is attached.

The object of the invention is thus to render renewed closure of a container of the type mentioned in the introduction considerably easier.

This object is achieved, in the case of the container of the type mentioned in the introduction, in that the element that can pierce the membrane is designed as part of the outlet body. It is particularly preferred here that the membrane is only pierced following connection of the outlet body to the outlet opening of the container, because this reliably avoids unintended emergence of the container contents, with the attendant difficulties, when the outlet nozzle is fitted.

Since, according to the invention, the piercing element is designed as part of the outlet element, use may be made of a closed closure cap which is known per se and can easily be fitted, e.g. screwed, onto the container with the membrane pierced and the outlet nozzle attached. The task of laboriously inserting an elongate piercing element into the narrow channel of the outlet nozzle is no longer necessary.

The position of the element for piercing the membrane can preferably be changed axially with respect to the connecting element, with the result that the membrane need not be pierced at the moment when the outlet nozzle is fitted on the outlet opening of the container. Rather, the membrane can be pierced at any desired later point in time by virtue of the axial change in the position of the piercing element.

In an advantageous configuration of the invention, the outlet body may have two parts which can be changed in terms of their axial position with respect to one another and of which one part bears the element for piercing the membrane and the other part bears the connecting element. In this case, the other part, which bears the connecting element, is preferably essentially annular and the part which bears the element for piercing the membrane is essentially tubular and is arranged essentially concentrically within the annular part. This means that the annular part can be fastened, e.g. screwed, on the neck of the container and it is only thereafter that the membrane can be pierced by axial displacement of the tubular part within the annular part.

For this purpose, it is proposed that the outlet opening of the container has an external thread onto which a first internal thread of the annular part can be screwed, and that the annular parts have a second internal thread into which the tubular part can be screwed by way of its external thread.

Membrane piercing, with the tubular parts only being turned slightly, which is relatively quick in comparison with the annular part being screwed slowly onto the container, is achieved if the second internal thread of the annular part has a larger pitch than the first internal thread of the same part.

The element for piercing the membrane is advantageously designed as a sharp edge of the tubular part.

In order to render piercing of the membrane easier, the outside of the outlet body, and in particular the outside of the tubular part, has at least one grip element, in particular wing-like protrusions, grooves or teeth, so that the axial position of the element for piercing the membrane can be changed with respect to the connecting element. For manual displacement of the piercing element, such grip elements provide a firm grip for the user's hand.

In a further configuration of the invention, drying out of the product in the open container is prevented if, in the attached state, the closure cap at least partially covers over the outlet body and closes off the outlet channel in particular.

Said closure cap preferably has at least one actuating element which, when the closure cap is attached, engages in the grip element, with the result that, when the closure cap turns, that part of the outlet body which bears the grip element also turns. The membrane may thus also be pierced when the closure cap is attached, by the closure cap being turned with respect to the container.

In a particularly preferred configuration of the invention, the closure cap has an internal thread which can be screwed onto an external thread of the annular part and is defined such that, when the closure cap is unscrewed from the annular part, the tubular part moves axially in the direction of the outlet opening of the container.

For this purpose, it is proposed that the second internal thread of the annular part be designed to run in the opposite direction from the external thread of the same part. The external thread is preferably a customary right-hand thread, with the result that the closure cap can be unscrewed from the annular part by being turned in the anticlockwise direction. The second internal thread of the annular part, however, is preferably a left-hand thread, with the result that, when the closure cap turns in the anticlockwise direction, that is to say during an unscrewing movement, the tubular part is simultaneously moved in the opposite direction toward the outlet opening of the container, and thus toward the membrane.

BRIEF DESCRIPTION OF THE DRAWINGS

Two exemplary embodiments of the invention are explained in more detail hereinbelow with reference to drawings, in which.

DETAILED DESCRIPTION OF THE INVENTION

The same designations have the same meaning in all the drawings and will therefore be explained, if appropriate, once only.

Figures 1A, 1B, 1C:
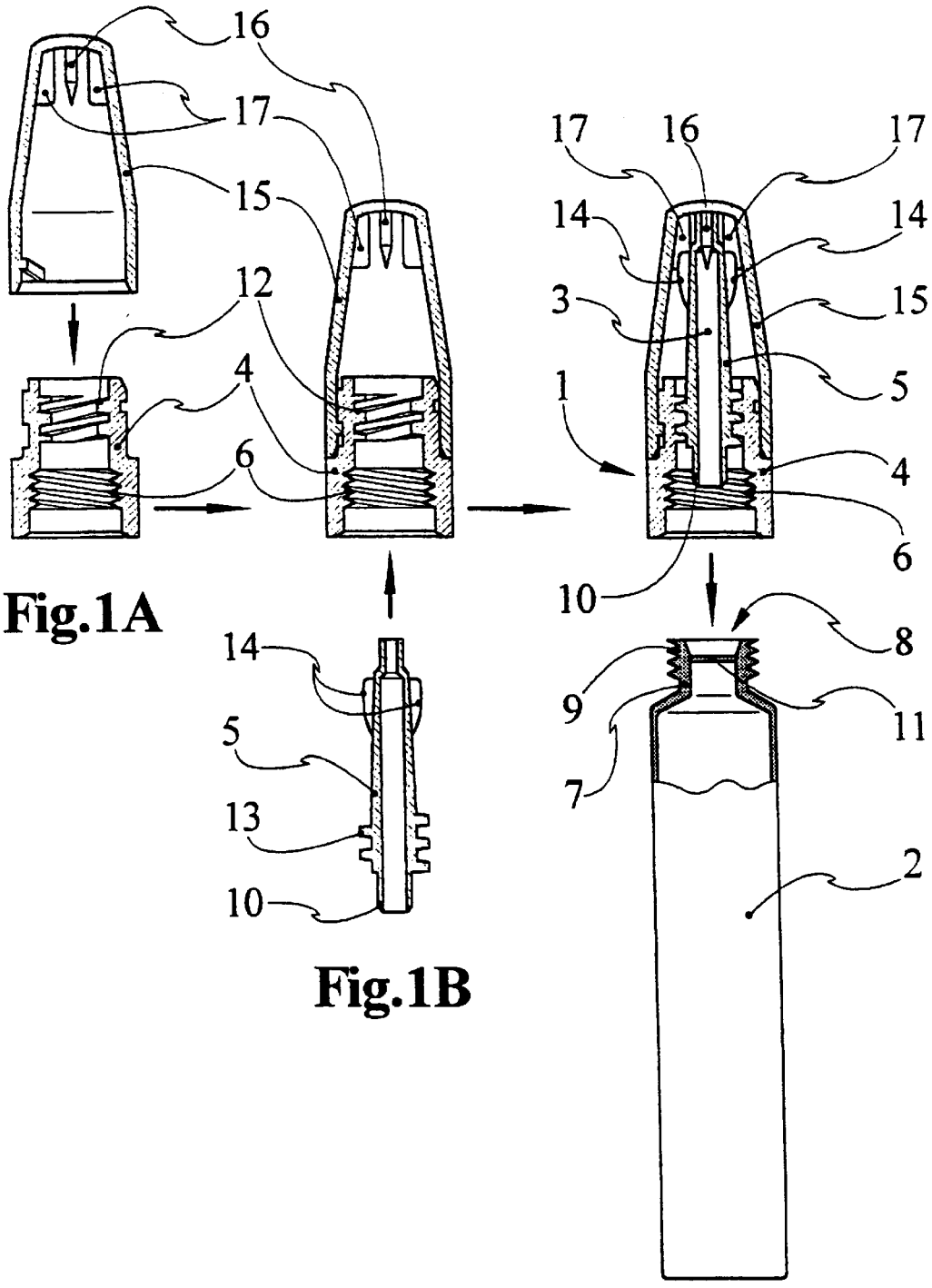
FIGS. 1A–1C show schematic illustrations, in section, of the assembly of the outlet nozzle and of the container according to a first exemplary embodiment of the invention.

The exemplary embodiment shows a container 2 in the form of a tube for a cyanoacrylate adhesive, which is also known as instant adhesive. The container 2 has an outlet opening 8 which is closed off by a membrane 11 (FIG. 1C). The outlet nozzle 1 of the container 2 has a two-part outlet body 4, 5 with an outlet channel 3. The outlet body comprises an annular part 4 and a tubular part 5 arranged therein in an axially displaceable manner (FIG. 1C).

The annular part 4 has a connecting element 6 which is configured as an internal thread and is provided for connecting outlet nozzle 1 to the neck 7 of the container 2, the neck 7 having an external thread 9 which corresponds to the internal thread 6, with the result that the annular part 4 can be screwed onto the neck 7 of the container.

The tubular part 5, which is arranged within the annular part 4, has, at its bottom end, an element 10 for piercing the membrane 11, said element 10 being in the form of a sharp, cutter-like bottom edge of the tubular part 5.

For axial displacement of the tubular part 5 with respect to the annular part 4, the latter has provided on its inside a second internal thread 12, which runs in the opposite direction from the first internal thread 6 and corresponds to a corresponding external thread 13 of the tubular part 5, with the result that the tubular part 5 can be screwed into the second internal thread 12 of the tubular part 4 by way of its external thread 13. Turning of the annular part 4 with respect to the tubular part 5 changes the mutual axial position of these parts, with the result that, with an annular part 4 screwed onto the container 2, the distance of the piercing element 10 from the membrane 11 changes during turning of the tubular part 5.

Turning of the tubular part 5 with respect to the annular part 4 is rendered easier by protrusions 14, which are fitted as grip elements on the outside of the annular part 5, in the top region of the latter.

The outlet nozzle 1 is closed off by a closure cap 15 which, on its inside, has a peg 16 which, with the closure cap 15 attached (FIG. 1C), projects into the outlet channel 3 and closes off the channel in this way.

Figures 2A, 2B, 2C:
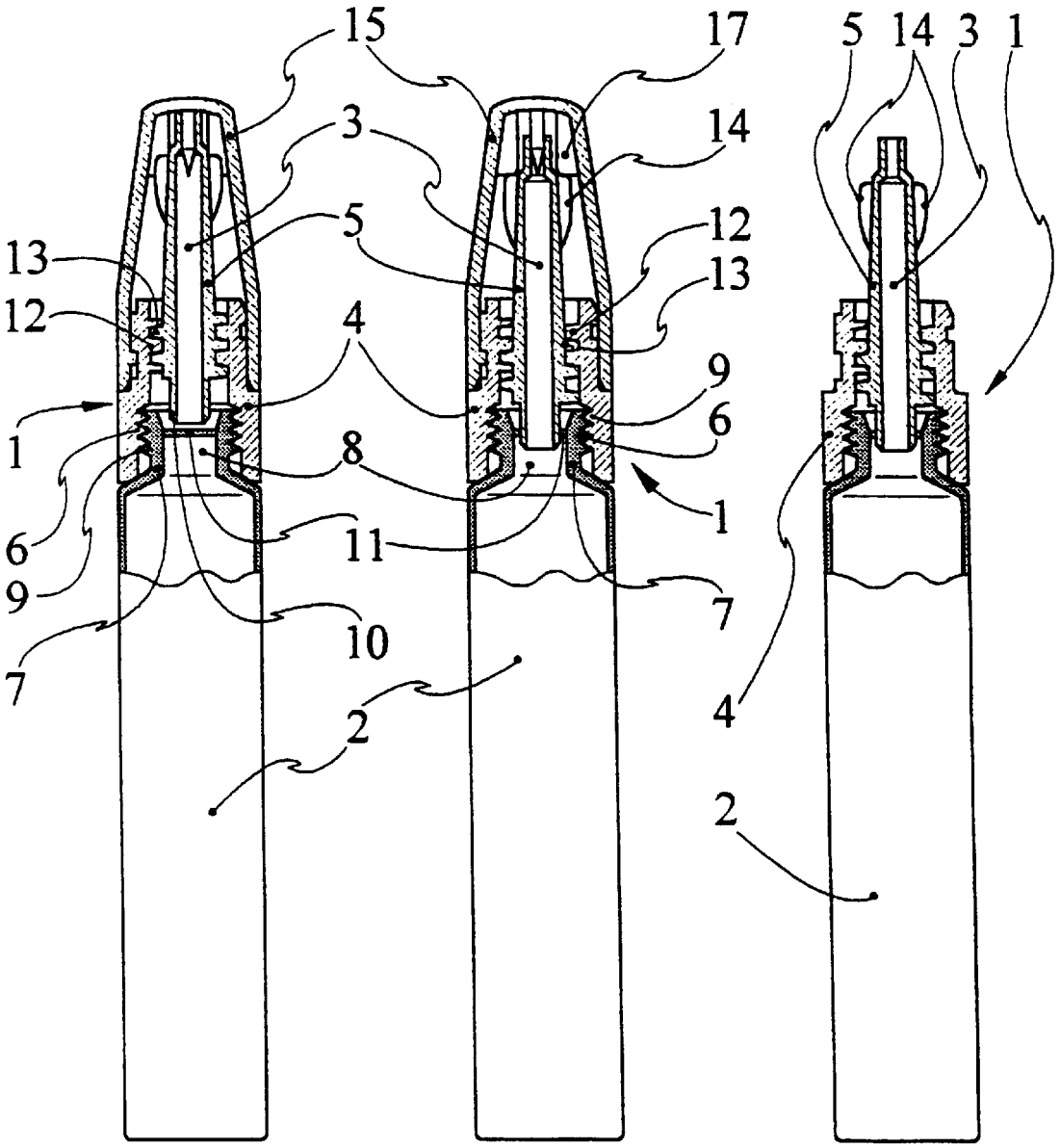
FIGS. 2A–2C show, in section, the container according to the previous figures as it is opened for the first time by the user.
Figure 3:
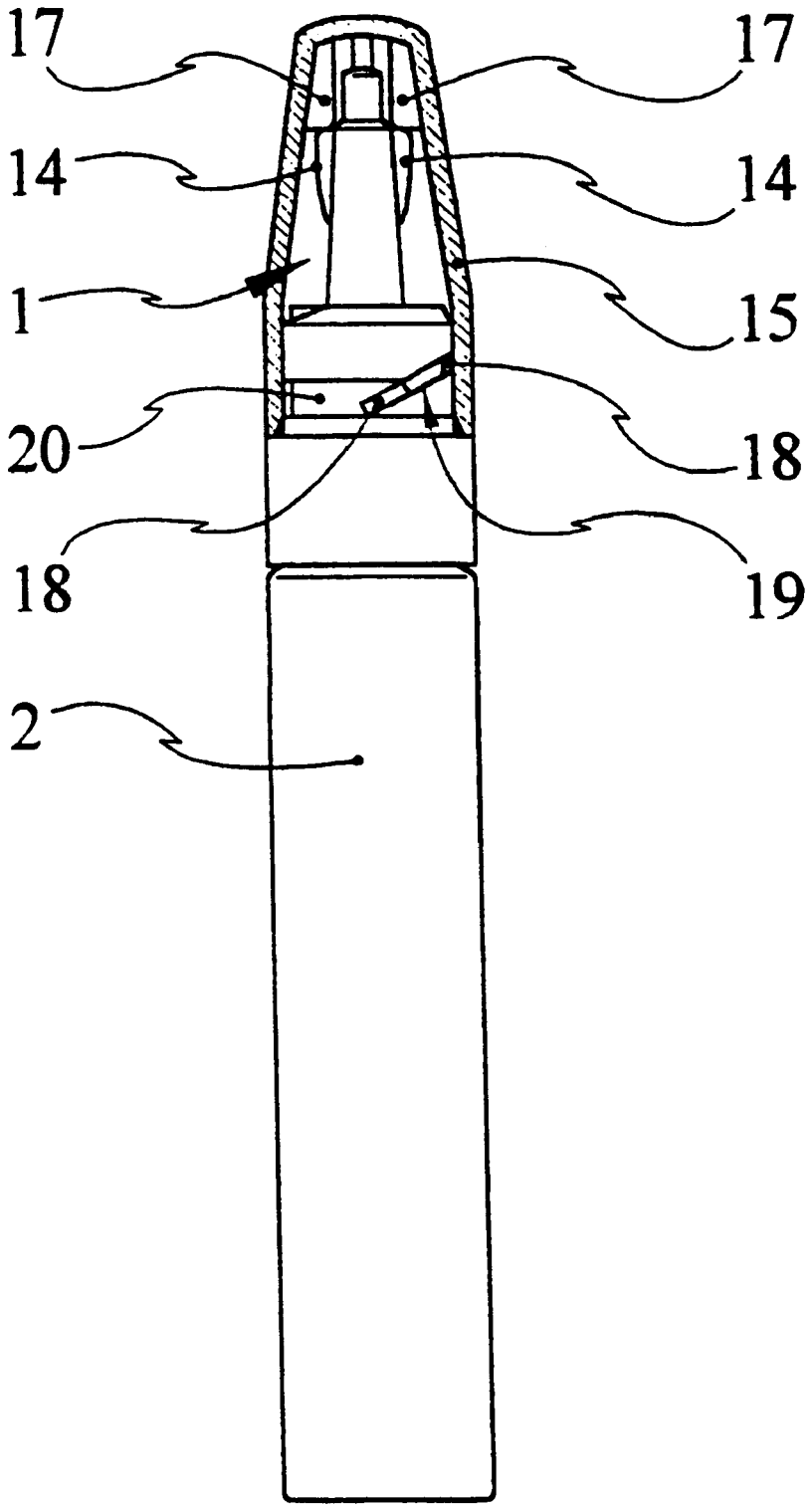
FIG. 3 shows a side view of the container according to the first exemplary embodiment, the closure cap being illustrated in section.

Furthermore, the inside of the closure cap 15 has integrally formed on it protrusions 17, which interact with actuating elements, with the protrusions 14, the grip elements, on the outside of the tubular part 5. The closure cap 15 has an internal thread 18, by means of which the cap 15 can be screwed on an external thread 19 of the annular part 4 (FIG. 3). The external thread 19 has a horizontal segment 20, with the result that, upon removal of the closure cap 15, the latter is first of all turned, over half a revolution, without axial displacement and turns the tubular part 5 in the process, which is thus screwed downward into the annular part 4, with the result that the sharp edge 10 (the element for piercing the membrane) is forced through the membrane 11, as is illustrated in FIGS. 2A and 2B, and the container 2 is thus opened. In this arrangement, the tubular part 5 may be fixed in the screwed-down position with respect to the annular part 4 by means of a snap-in or latching connection (not depicted in the present example).

Figure 1D:
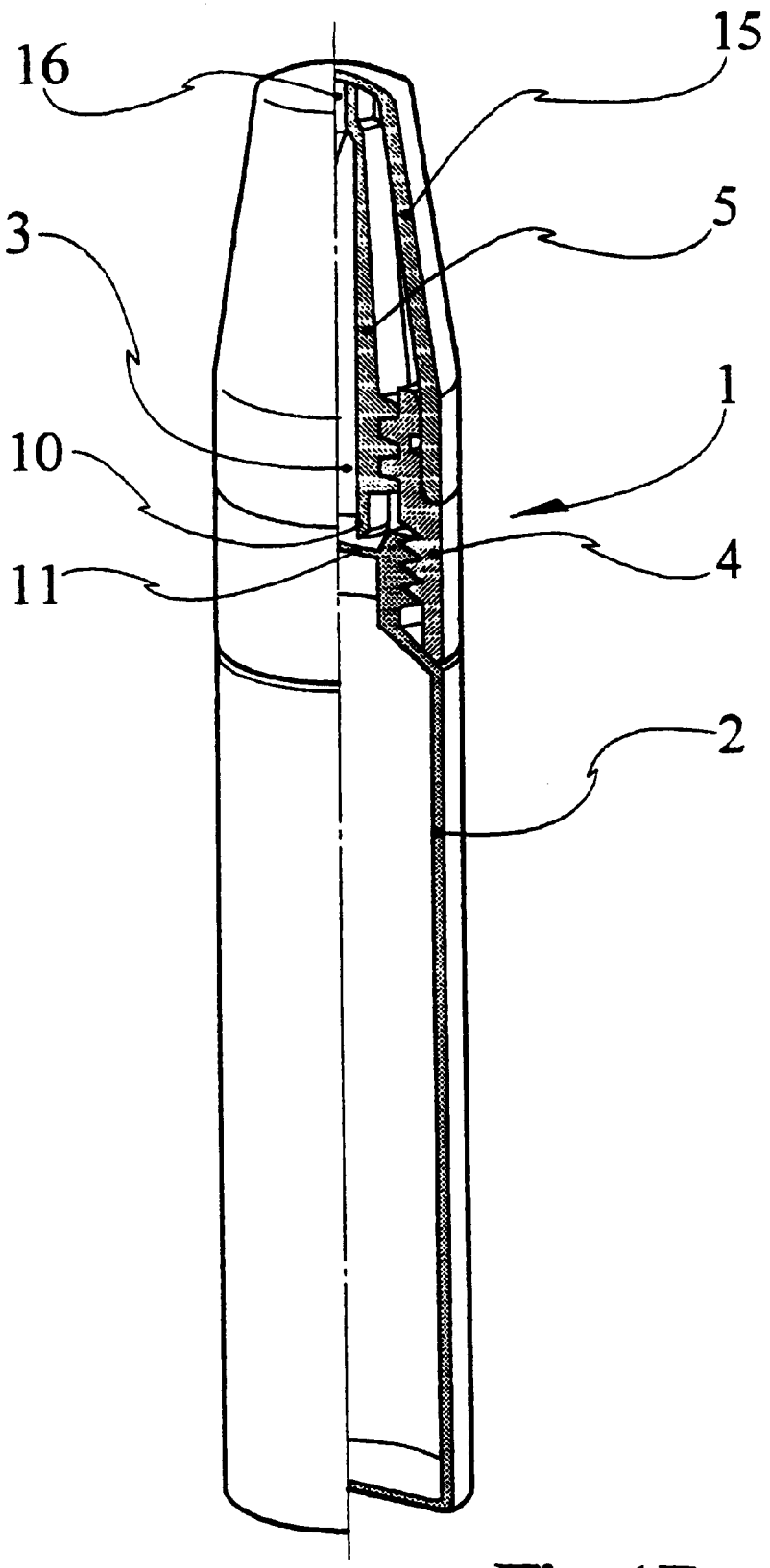
FIG. 1D shows a perspective, partially sectioned illustration of the assembled container with the outlet nozzle and the closure cap according to FIGS 1A to 1C, in the state in which said container is sold.

During assembly of the system, comprising an outlet nozzle 1 and the container 2, at the manufacturer's, first of all the closure cap 15 is screwed onto the annular part 4 (FIG. 1A). The tubular part 5 is then guided through the annular part 4 from the underside and screwed firmly therein (FIG. 1B). Thereafter, the outlet nozzle 1 is screwed onto the neck 7 of the container 2, as is illustrated in FIG. 1C. This produces a container with an outlet nozzle corresponding to FIG. 1D.

Figure 2D:
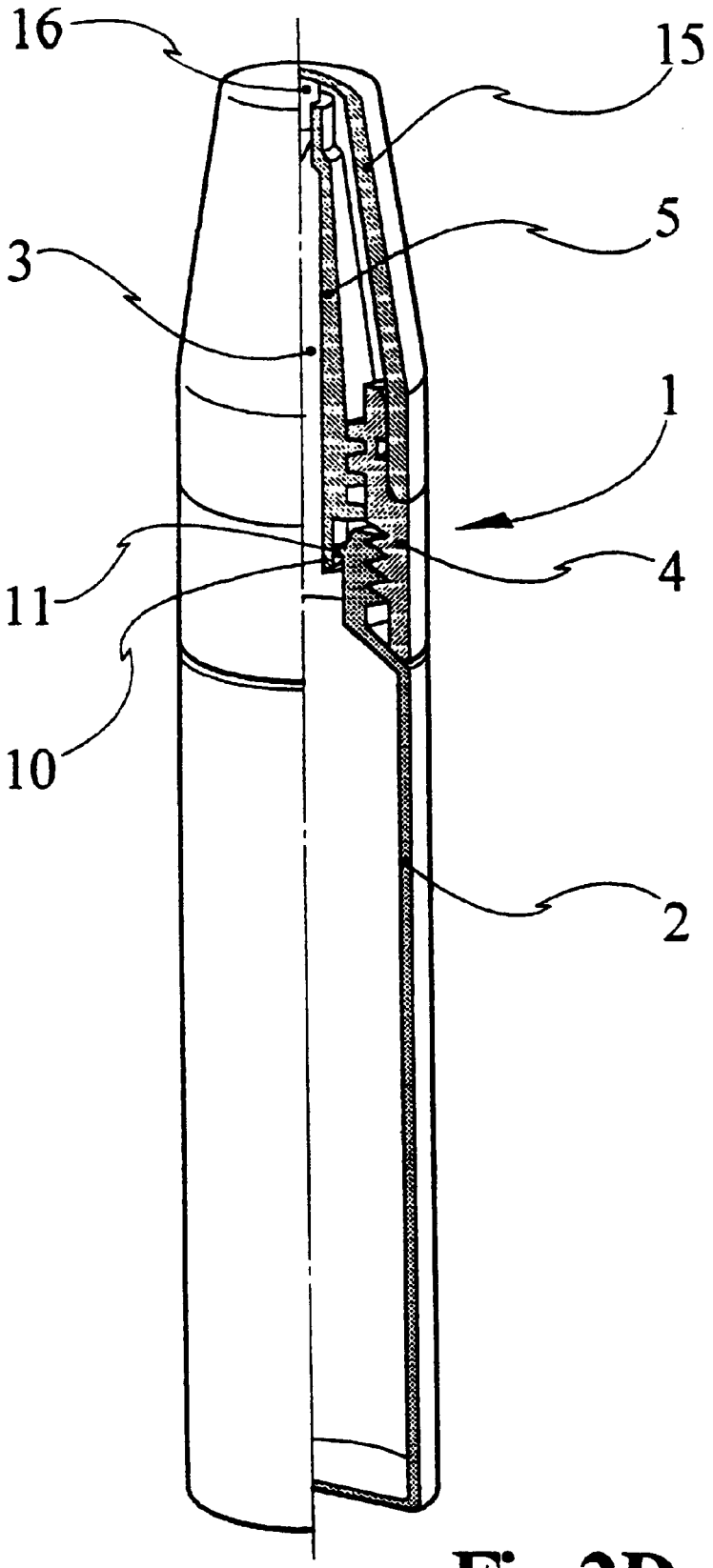
FIG. 2D shows a perspective partially sectioned illustration of the container corresponding to FIG. 2B, that is to say immediately after the membrane has been pierced.
Figure 2E:
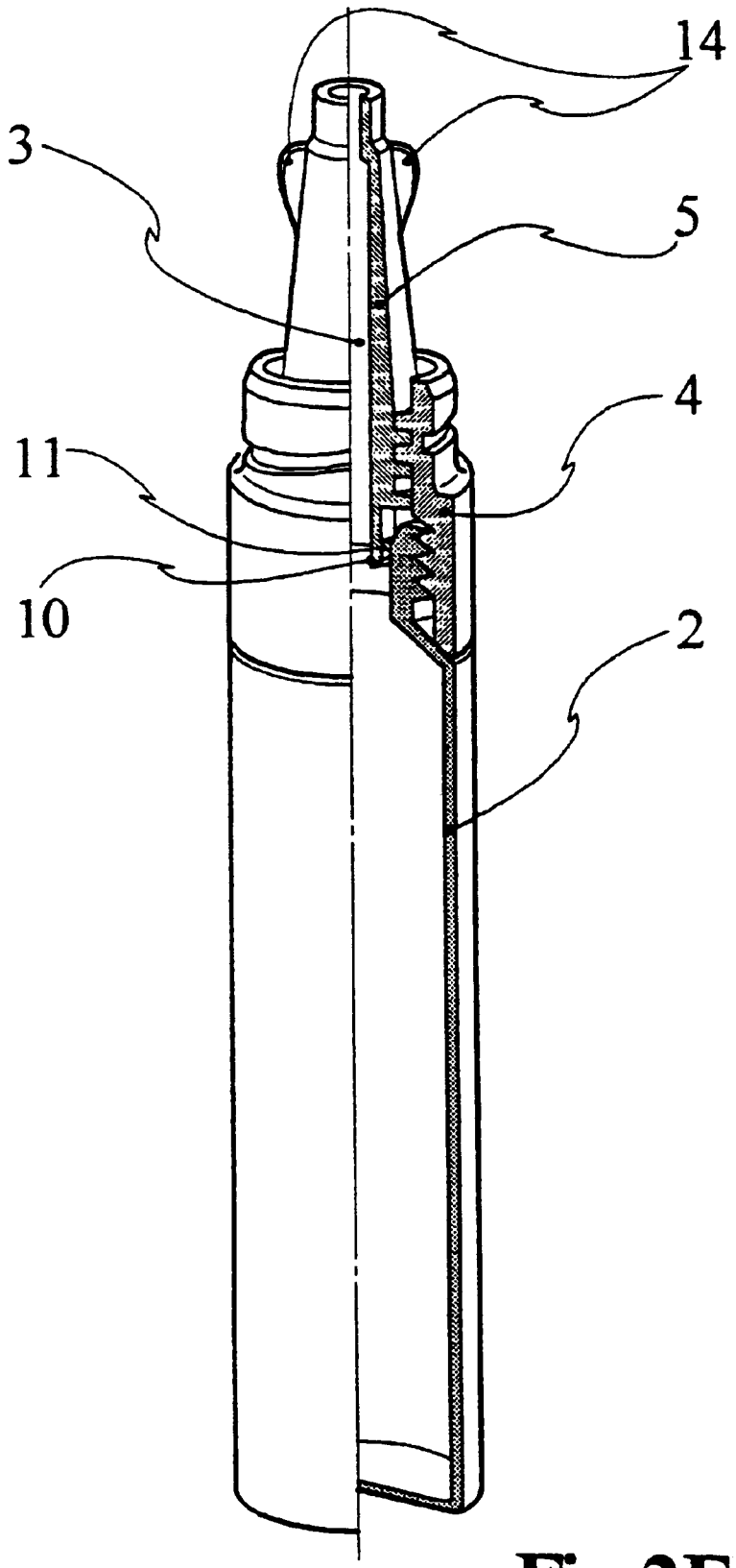
FIG. 2E shows a perspective partially sectioned illustration of the container corresponding to FIG. 2D after the membrane has been pierced and during removal of the closure cap.

When the container 2 is used for the first time, the closure cap 15 is turned, with the result that the tubular part 5 is transferred from the position shown in FIG. 2A into the position according to FIG. 2B, the membrane 11 being pierced by the sharp bottom edge 10 of the tubular part 5. This situation is also illustrated in FIG. 2D. Continued turning of the closure cap 15 allows the latter to be unscrewed from the container (FIG. 2E), with the result that the user obtains the container which is illustrated in FIG. 2C, from which he can remove the liquid or pasty product via the outlet channel.

With the aid of the outlet nozzle 1 corresponding to the invention, the membrane 11 in the outlet opening 8 of the container 2 can easily be opened prior to the container being used for the first time, by closure cap 15 being turned, without there being any possibility in this case of unintended outflow of the product accommodated in the container 2.

Figure 4:
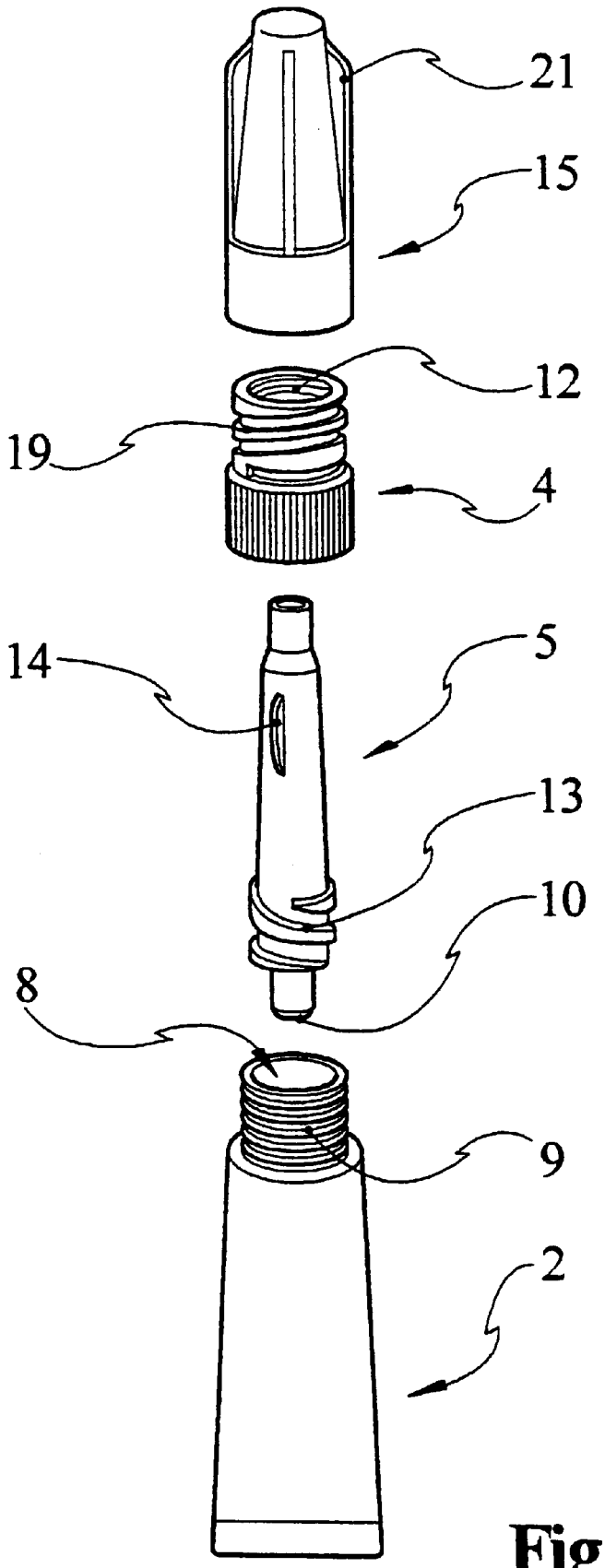
FIG. 4 shows an exploded illustration of the container according to a second, particularly preferred exemplary embodiment according to the invention.
Figure 5:
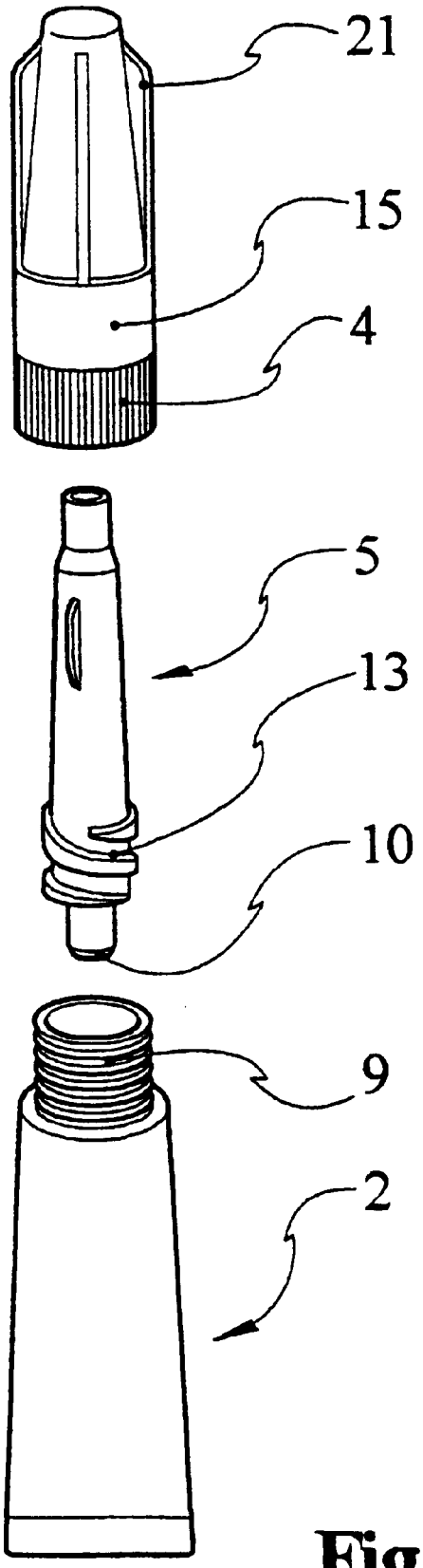
FIG. 5 shows a perspective illustration of the second step, carried out by the manufacturer, for assembling the container according to FIG. 4.
Figure 6:
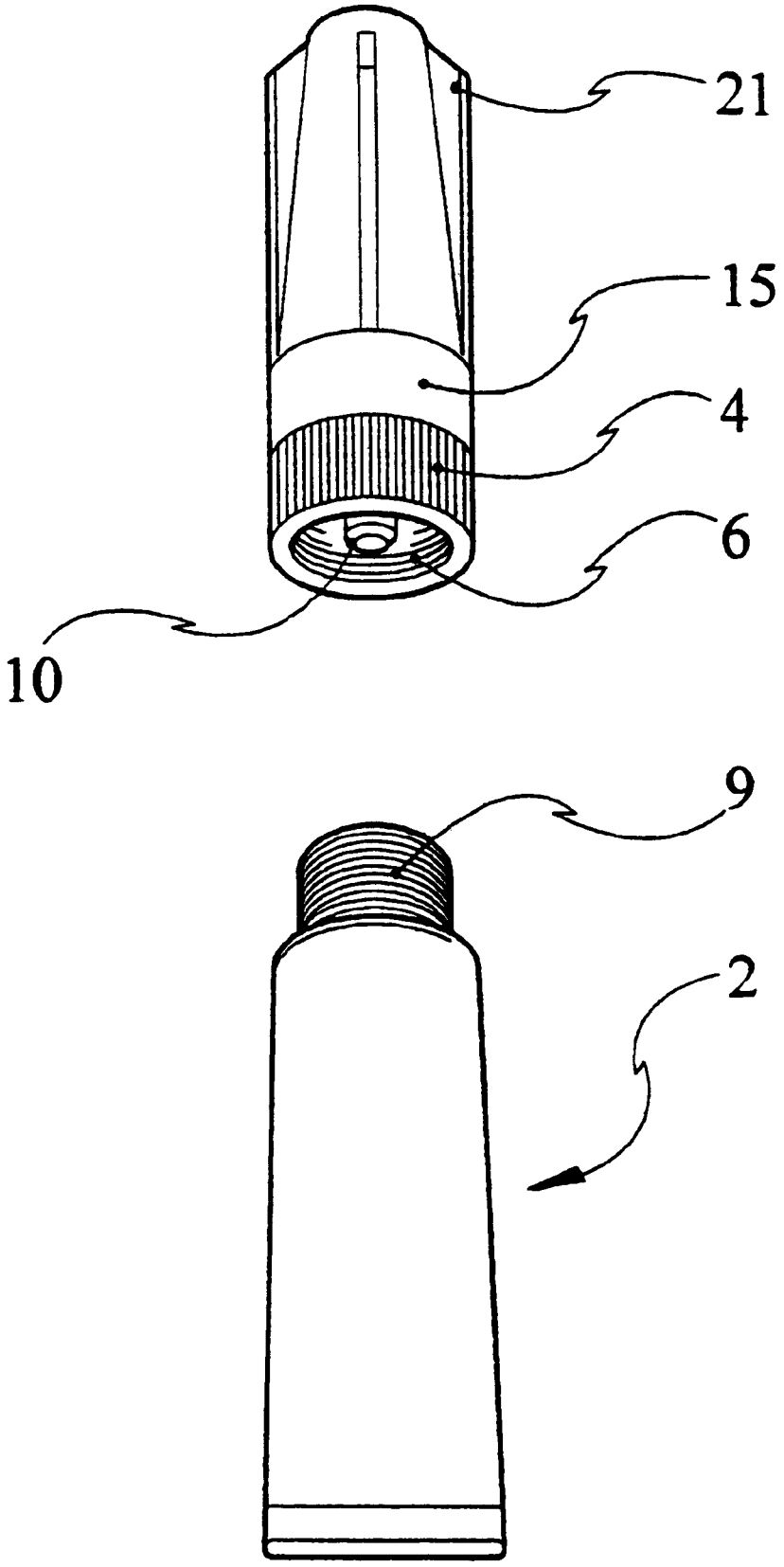
FIG. 6 shows the third step during the assembly of the container according to FIG. 4.

FIGS. 4 to 6 illustrate a particularly preferred exemplary embodiment of the invention. It can be seen in FIG. 4 that the external thread 13 of the tubular part 5 is designed as a left-hand thread with a larger pitch than the external thread 19 of the tubular part 4, said external thread 19 being provided at the right-hand threads with a smaller pitch. The external threads 13 and 19 correspond to the internal thread 12 of the annular part 4 and the internal thread 18 of the closure cap 15.

In order to render the unscrewing action easier, the closure cap 15 has outwardly extending wings 21.

In the illustration according to FIG. 5, the closure cap 15 has been screwed onto the annular part 4. In a further step (FIG. 6), the tubular part 5 is then screwed into the annular part 4. In this state, the protrusions 14 of the tubular part 5 pass into the region of the inner protrusions 17 of the closure cap 15. In order that the protrusions 17 of the closure cap 15 grip the protrusions 14 over a sufficient length during unscrewing of the closure cap, in order to move the tubular part 5 downward for the purpose of piercing the membrane, the external thread 19 (righthand thread) of the tubular part 4 and the corresponding internal thread 18 of the closure cap 15 have a smaller pitch than the external threads 13 of the tubular part 5 and the corresponding internal thread 12 of the annular part 4. During unscrewing of the closure cap 15 from the annular part 4, the closure cap 15 thus moves axially upward only to a slight extent, while the tubular part 5 moves downward, in the direction of the outlet opening 8 of the container 2, over a considerably larger distance. Once the element 10 has pierced the membrane, the protrusions 14 of the tubular part 5 are disengaged from the protrusions 17 of the closure cap 15, with the result that, when the closure cap is unscrewed further, there is no further screwing movement of the tubular part 5.

It may be provided for the part which is illustrated at the top in FIG. 6, and is made up of the closure cap 15, the annular part 4 and the tubular part 5, to be screwed onto the outlet opening 8 of the container 2 by the user before he unscrews the closure cap 15 from the annular part 4. In order to render the screwing-on action easier, the outside of the annular part 4 is grooved.

List of Designations

1 Outlet nozzle
2 Container
3 Outlet channel
4 the other part, annular part
5 one part, tubular part
6 Connecting element, first internal thread
7 Neck
8 Outlet opening
9 External thread
10 Piercing element
11 Membrane
12 Second internal thread
13 External thread
14 Protrusion, grip element
15 Closurecap
16 Peg
17 Protrusion, actuating element
18 Internal thread
19 External thread
20 Segment
21 Wing

What is claimed is:

1. A container comprised of:

(i) an outlet nozzle;

(ii) a closure cap for the outlet nozzle;

(iii) an outlet opening closed off by a membrane, wherein the outlet nozzle is comprised of an outlet body with an outlet channel and a connecting element for connecting the outlet body to the outlet opening; and (iv) an element capable of piercing the membrane during or after connection of the outlet body to the outlet opening and which is part of the outlet body, wherein (a) the position of the element can be changed axially with respect to the connecting element;

(b) the outlet body comprises a part A and a part B which can be changed in terms of their axial position with respect to one another, part A bearing the element capable of piercing the membrane and being essentially tubular and arranged essentially concentrically within part B, part B bearing the connecting element and being essentially annular;

(c) the outlet opening has an external thread onto which a first internal thread of part B can be screwed; and (d) part B has a second internal thread into which part A can be screwed by means of the external thread.

2. The container of claim 1 wherein the second internal thread of part B has a larger pitch than the first internal thread of part B.

3. The container of claim 1 wherein the element capable of piercing the membrane is present as a sharp edge of part A.

4. The container of claim 1 wherein the outside of the outlet body has at least one grip element.

5. The container of claim 1 wherein the outside of part A has at least one grip element.

6. The container of claim 1 wherein the closure cap, when in an attached state, at least partially covers the outlet body.

7. The container of claim 1 wherein the closure cap, when in an attached state, closes off the outlet channel.

8. The container of claim 1 wherein the outside of one part of the outlet body has at least one grip element and the closure cap has at least one actuating element which, with the closure cap attached, engages in the at least one grip element, with the result that, when the closure cap turns, the part of the outlet body having the at least one grip element also turns.

9. The container of claim 1 wherein the closure cap has an internal thread which can be screwed onto an external thread of part B, wherein when the closure cap is unscrewed from part B, part A moves axially in the direction of the outlet opening.

10. The container of claim 4 wherein the grip element comprises one or more protrusions having the shape of a wing, groove, or tooth.

11. The container of claim 9 wherein the second internal thread of part B runs in a direction opposite to that of the external thread of part B.

* * * * *